United States Patent [19]

Carnavos et al.

[11] 4,216,575

[45] Aug. 12, 1980

[54] METHOD OF REFORMING THE FINS OF A FINNED TUBE

[75] Inventors: Theodore C. Carnavos, Bethel; Walter J. Golymbieski, Woodbury, both of Conn.

[73] Assignee: Noranda Mines Limited, Toronto, Canada

[21] Appl. No.: 9,399

[22] Filed: Feb. 1, 1979

[51] Int. Cl.[2] ..... H01R 43/08

[52] U.S. Cl. ..... 29/597; 72/283; 72/370

[58] Field of Search ..... 29/597, 157.3 A; 310/235, 236; 72/283, 370

[56] References Cited

U.S. PATENT DOCUMENTS

| | | | |
|---|---|---|---|
| 3,376,443 | 4/1968 | McColl | 29/597 X |
| 3,422,518 | 1/1969 | French | 29/157.3 A |
| 3,987,539 | 10/1976 | Gravener | 29/597 |

*Primary Examiner*—Carl E. Hall

*Attorney, Agent, or Firm*—Fleit & Jacobson

[57] ABSTRACT

A method of reforming the fins of a finned tube is disclosed. The method comprises forming a tube having a plurality of internal longitudinal fins with a V-notch at the tip of the fins, and reforming the fins of the tube over a shaped plug, in long lengths, to spread the tips of the V-notch so that the tips of the fins are wider than the fin thickness.

6 Claims, 6 Drawing Figures

METHOD OF REFORMING THE FINS OF A FINNED TUBE

This invention relates to the making of a finned tube for various applications and, more particularly, to the making of finned tubes for use in the manufacture of electric motor commutators.

BACKGROUND OF THE INVENTION

It is commonly known to make tubes with internal fins for improving the heat transfer characteristics of the tubes and also for other applications. Such fins normally have rectangular profiles. However, the rectangular profile does not always provide an acceptable profile and it is often necessary to reform the fins to more suitable configurations. For example, one particular application is the making of an electric motor commutator wherein a finned tube section together with a shaft bushing is placed in a mold and plastic material forced between the shaft bushing and the tube under heat and pressure to anchor the fins into the plastic material. The tube is thereafter cut longitudinally between the fins to electrically insulate the commutator bars from each other. It has been common practice to provide the fins with various projections or to deform the fins to provide an anchor to prevent loosening of the commutator bars, especially in modern high speed universal motors wherein the commutator bars are subjected to very high centrifugal forces. One particular method of reforming the fins is disclosed in U.S. Pat. No. 3,987,539 granted Oct. 26, 1976. In the patent, a mandrel is used having on its outer surface a number of forming surfaces which change progressively from a sharp profile at the front or leading end of the mandrel to a substantially flat profile at the rear or trailing end. The reforming operation is performed on individual commutator tubes of short length (a few times the length of the final commutator). With the above method, the short commutator tubes require a very high degree of dimensional tolerance stability to reform the rectangular fin tip properly, otherwise a large number of rejects occurs.

SUMMARY OF THE INVENTION

It is therefore the object of the invention to provide a finned tube in which the fins can be easily reformed to a desired shape with a minimum amount of rejected parts.

The method, in accordance with the invention, comprises forming a tube having a plurality of internal longitudinal fins with a V-notch at the tip of the fins, and reforming the fins of the tube over a shaped plug to spread the tips of the V-notch so that the tips of the fins are wider than the fin thickness.

The angle of the V-notch before deformation is between 60° and 140° and is increased during reformation over the shaped plug.

The reforming step is preferably made on a draw bench although it could also be made by a swaging operation.

When the tube is used for the manufacture of electric motor commutators, a long length of tube with the reformed fins is cut into sections corresponding approximately to the length of a commutator, a shaft bushing is inserted within each tube section and the annular space between the shaft bushing and the tube is filled with plastic material. The tube is then cut longitudinally between the fins to form individual commutator bars which are firmly anchored in the plastic material due to spreading of the tips of the V-notch in the fins.

SHORT DESCRIPTION OF THE DRAWINGS

The invention will now be disclosed, by way of example, with reference to a preferred embodiment illustrated in the accompanying drawings in which.

DESCRIPTION OF A PREFERRED EMBODIMENT

Figure 1:
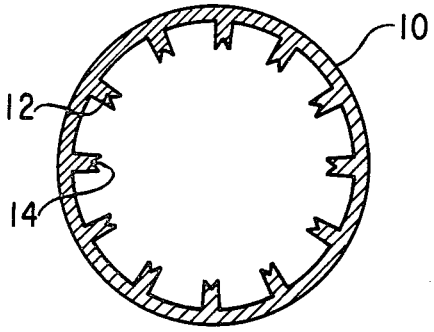
FIG. 1 illustrates a transverse section view through a tube having a plurality of internal longitudinal fins with a V-notch at the tip of the fins.

Referring to the drawings, there is shown a tube 10, preferably made of copper, having a plurality of internal fins 12 with a V-shaped notch 14 at the tip of the fins. The tube 10 may have different numbers of fins depending on the application. If the tube is used for making electric motor commutators, the number of fins will depend on the number of commutator bars. The fins 12 may be made by a number of known metal working methods, such as but not limited to extruding, drawing or cold forming (swaging), with swaging being the preferred method, as disclosed in U.S. Pat. No. 3,422,518 issued Jan. 21, 1969. Tube 10 may be made of any length but normally will be many times the length of a final commutator.

Figure 2:
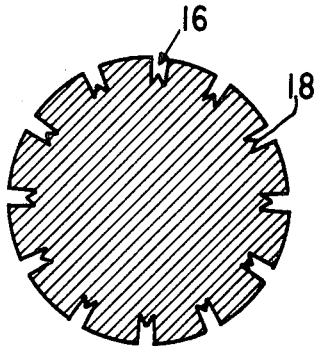
FIG. 2 is a transverse section view through a mandrel for making the fins of the tube shown in FIG. 1.
Figure 3:
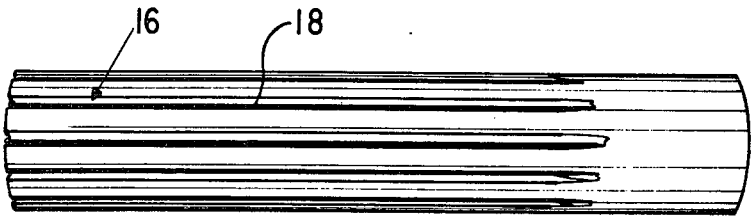
FIG. 3 is a perspective view of the mandrel of FIG. 2.

FIGS. 2 and 3 illustrate the mandrel which is used in the making of the tube 10 shown in FIG. 1 of the drawings. The mandrel has a plurality of grooves 16 corresponding to the number of fins 12. The angle of the V shaped boss 18 in the groove is preferably about 60° although the boss may be at any angle in the range of 60° to 140°. In the cold forming of the tube by swaging, as disclosed in the above patent, the mandrel is inserted into a smooth tube and the tube is hammered on the outside until the metal has filled the grooves 16 to form the fins. During this operation, the original smooth tube is reduced in cross-sectional area by factors in the range of 1.75 to 3.25 depending on the configuration to be produced.

Figure 4:
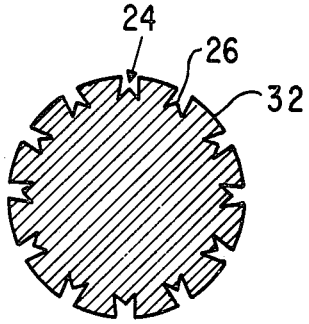
FIG. 4 is a transverse section view through the plug used for reforming the tube of FIG. 1.
Figure 5:
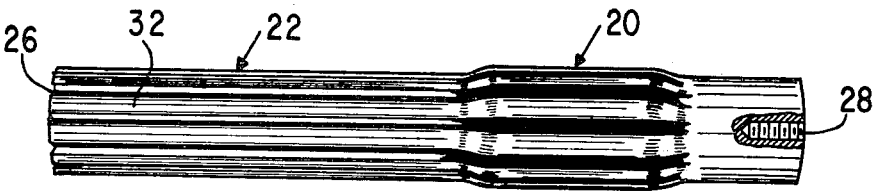
FIG. 5 illustrates a perspective view of the plug shown in FIG. 4.
Figure 6:
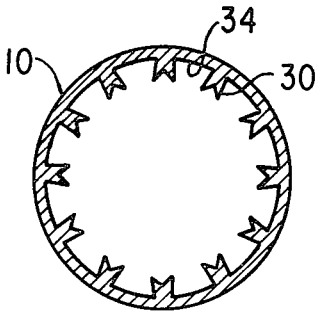
FIG. 6 is a transverse section view of the tube reformed by the plug shown in FIGS. 4 and 5.

FIGS. 4 and 5 illustrate a draw plug which is used to reform the tube to the shape shown in FIG. 6. The tube is reformed by a drawing operation although it could also be done by swaging. The draw plug has a guide portion 20 which has an outside diameter slightly smaller than the inside diameter of the tube so as to permit the tube to easily slide over the guide portion of the draw plug, and a deforming portion 22 of a diameter such as to perform a predetermined reduction in cross-sectional area of the tube. Such reduction may be of any desired value up to 45%. The draw plug has a plurality of grooves 24 corresponding to the number of fins to be reformed in a tube. The width of the grooves is related to the desired amount of deformation of the tip of the fins. The angle of the boss 26 in the groove 24 is also slightly larger than the angle of the boss 18 in the mandrel of FIGS. 2 and 3 and preferably in the range of 60° to 140° depending on the amount of desired deformation.

In operation, the plug is inserted within a tube to be reformed with the fins of the tube resting in the grooves 24 of the plug. In this position the V-shaped notches 14 are also resting on the bosses 26 in the grooves 24 of the plug that serve as alignment guides. The tube is then drawn through a die surrounding the tube and the plug, while the plug is maintained stationary by way of means threaded or otherwise attached at 28 into the end of the plug. The tips of each V-shaped notch will be spread as shown at 30 in FIG. 6 of the drawings.

It will be easily seen that the above disclosed method has great advantages over the method disclosed in U.S. Pat. No. 3,987,539 because, first of all, it uses a draw plug provided with a guide portion 20 which ensures that the fins will always be in perfect alignment with the reforming grooves 24. In addition, the V-shaped notch provides a weak portion in the fins which ensures that the fins will be symetrically deformed. This is very important in the making of commutator bars in order to provide adequate anchoring of the bars. If the fin tips are not properly reformed, a high rate of rejections will occur or the probability of a commutator bar loosening in operation, causing a field failure, will increase due to the centrifugal forces exerted by high speed rotation of the commutator. The reforming process also ensures a round, smooth outer tube surface 10 because the plug has an outside surface 32 (FIG. 5) which contacts the wall 34 (FIG. 6) between the fins thus preventing flattening of the wall between the fins during the reforming operation due to drawing through a die.

If the tube is used for the making of commutator bars, the tube is cut into a plurality of short tube sections. Each tube section and a shaft bushing are then placed concentrically in a plastic molding machine and plastic forced between the tube section and the shaft bushing under heat and pressure such as disclosed in U.S. Pat. No. 3,987,539, for example. The spreaded tips of the V-notch fins will be firmly embedded in the plastic material so that, after the tube is cut longitudinally between the fins to make the commutator bars, such bars will be firmly anchored in the mass of plastic material.

It will be understood that the finned tube reformed in accordance with the method of the present invention may also be used for applications other than the manufacture of commutator bars. For example, it may be used to increase the heat transfer area of the fins and so improve the heat transfer characteristics of the tube. It may also be done for certain heat pipe applications wherein it is desirable to have the distance at the entrance of the grooves between the fins narrower than at the bottom of the grooves to increase pumping power without sacrificing the heat transfer capacity of the tube.

I claim:

1. A method of making a finned tube comprising:

(a) forming a tube having a plurality of internal longitudinal fins with a V-notch at the tip of the fins; and (b) reforming the tips of the fins of said tube over a shaped plug having a guide portion which has an outside diameter slightly smaller than the inside diameter of the tube and a deforming portion of a diameter such as to perform a predetermined reduction in cross-sectional area of the tube, said plug having a plurality of grooves corresponding to the number of fins to be reformed in the tube and extending longitudinally through said guide and deforming portions, said grooves having an undercut of a width which is related to the desired amount of deformation of the tips of the fins and V-shaped bosses at the bottom which engage the V-shaped notches in the guide portion of the plug to ensure perfect alignment of the fins with the deforming grooves and symmetrical splitting of the tips of the V-shaped notches so that the tips of the fins are wider than the fin thickness.

2. A method as defined in claim 1, wherein the angle of the V-notch in the fins before deformation is between 60° and 140°.

3. A method as defined in claim 1, wherein the reforming step is made on a draw bench.

4. A method as defined in claim 1, wherein the tube is used for the manufacture of electric motor commutators, and further comprising the steps of cutting the tube into sections corresponding approximatively to the length of a commutator, inserting a shaft bushing within each tube section, filling the annular space between the shaft bushing and the tube with plastic material, and slotting the tube longitudinally between the fins to form individual commutator bars firmly anchored in the plastic material.

5. A method as defined in claim 1 wherein the tube is formed over a mandrel having a plurality of grooves with an inverted V-shaped boss at the bottom so as to produce the V-shaped notches at the tip of the fins.

6. A method of making a finned tube comprising:

(a) forming a tube having a plurality of internal longitudinal fins with a V-notch at the tip of each fin;

(b) providing a shaped plug having a guide portion with an outside diameter slightly smaller than the inside diameter of the tube and a deforming portion having a diameter suitable for performing a predetermined reduction in cross-sectional area of the tube, said plug having a plurality of grooves corresponding to the number of fins in the tube and extending longitudinally through said guide and deforming portions, said grooves each having an undercut defining a V-shaped boss at the bottom of the groove, said undercut being of a width sufficient to spread the fins so that the tips of the fins are wider than the fin thickness;

(c) positioning the tube over said plug with said V-shaped bosses at the bottoms of said grooves in the guide portion engaging the V-shaped notches in the tips of the fins to accurately align the fins in said grooves; and (d) shaping said tube over said deforming portion of said plug to effect said predetermined reduction of the cross-sectional area of the tube and spreading of the tips of the fins.

* * * * *